US007578099B2

(12) United States Patent
Schlegel

(10) Patent No.: US 7,578,099 B2
(45) **Date of Patent: *Aug. 25, 2009**

(54) PROTECTIVE ENCLOSURE APPARATUS TEMPORARILY ATTACHABLE TO A UTILITY POLE BASE

(75) Inventor: Robert R. Schlegel, Cranbury, NJ (US)

(73) Assignee: PenCell Plastics, Inc., Rocky Mount, NC (US)

( * ) Notice: Subject to any disclaimer, the term of this patent is extended or adjusted under 35 U.S.C. 154(b) by 202 days.

This patent is subject to a terminal disclaimer.

(21) Appl. No.: 11/544,828

(22) Filed: Oct. 6, 2006

(65) Prior Publication Data

US 2008/0083192 A1 Apr. 10, 2008

(51) Int. Cl.
*E04C 2/52* (2006.01)

(52) U.S. Cl. ..... 52/3; 174/50; 174/91; 52/220.1; 52/296; 52/DIG. 12

(58) Field of Classification Search ..... 52/220.1, 52/292, 720.1, 301, 3, 295, 296, 297, DIG. 12; 174/91, 92, 38, 50, 535; 220/3.2, 3.3, 3.4, 220/3.5, 3.6, 3.7, 3.8, 3.9, 3.92, 3.94, 475
See application file for complete search history.

(56) References Cited

U.S. PATENT DOCUMENTS 1,419,108 A * 6/1922 Bitting ..... 52/168
2,561,461 A * 7/1951 Coleman, Jr. ..... 52/269
3,343,322 A * 9/1967 Lurkis et al. ..... 52/298
3,563,502 A * 2/1971 Dayson ..... 52/98
3,853,291 A * 12/1974 Burke ..... 248/158
3,944,718 A * 3/1976 Bright ..... 174/50
4,007,564 A * 2/1977 Chisholm ..... 52/98
4,079,559 A * 3/1978 Tenbrummeler ..... 52/295
4,158,102 A * 6/1979 Bright ..... 174/37
4,295,308 A * 10/1981 Korfanta ..... 52/296
4,533,786 A 8/1985 Borgmeyer et al.
4,793,111 A * 12/1988 Shewchuk ..... 52/298
5,201,599 A 4/1993 Kulp et al.
5,266,738 A 11/1993 MacVoy
5,412,960 A * 5/1995 James et al. ..... 70/63
5,481,846 A 1/1996 Macchietto
5,483,019 A * 1/1996 Tourigny ..... 174/45 R
5,524,411 A 6/1996 Crossman
5,580,022 A 12/1996 Bach et al.
5,664,394 A 9/1997 Sweeney
5,739,464 A 4/1998 Adkins et al.
5,749,555 A 5/1998 Albrecht
5,878,540 A * 3/1999 Morstein ..... 52/296

(Continued)

*Primary Examiner*—Richard E Chilcot, Jr.
*Assistant Examiner*—Matthew J Gitlin
(74) *Attorney, Agent, or Firm*—Sperry, Zoda & Kane

(57) ABSTRACT

A protective enclosure apparatus detachably securable with respect to a utility pole base having utility apparatus such as wires, cables and support structure extending therefrom. The enclosure includes a base with an access opening attachable directly to the utility pole base with a support frame securable thereto and extending outwardly therefrom. A housing is secured to the support frame to define a containment chamber therewithin for preventing access to the utility apparatus therein. The base member defines a plurality of mounting slots normally oriented extending radially and in communication with the access opening to facilitate mounting of the base with respect to various configurations of utility pole bases having four post mounting systems.

22 Claims, 4 Drawing Sheets

U.S. PATENT DOCUMENTS

| | | | | |
|---|---|---|---|---|
| D411,509 | S | 6/1999 | Schlegel | |
| 5,975,727 | A | 11/1999 | Morstein et al. | |
| 6,021,614 | A * | 2/2000 | Krieger | 52/301 |
| 6,186,468 | B1 | 2/2001 | Schlegel | |
| 6,216,414 | B1 | 4/2001 | Feldberg | |
| 6,439,344 | B1 * | 8/2002 | Cole | 182/113 |
| 6,464,196 | B1 | 10/2002 | Crookham et al. | |
| 6,518,499 | B1 | 2/2003 | Kessler | |
| 6,640,517 | B2 * | 11/2003 | Mitchell | 52/298 |
| 6,910,826 | B1 | 6/2005 | Damiano | |
| 6,971,320 | B1 | 12/2005 | Maldonado-Cortés et al. | |
| 6,988,700 | B2 * | 1/2006 | Cote | 248/519 |
| 6,997,426 | B1 | 2/2006 | Barrepski | |
| 7,219,873 | B2 * | 5/2007 | Harwood | 248/519 |
| D555,116 | S * | 11/2007 | Schlegel et al. | D13/184 |
| 2005/0126816 | A1 * | 6/2005 | Mixson | 174/100 |
| 2005/0252124 | A1 * | 11/2005 | Bergman | 52/296 |
| 2005/0285011 | A1 * | 12/2005 | Harwood | 248/519 |
| 2006/0231279 | A1 * | 10/2006 | Burke et al. | 174/50 |
| 2007/0022706 | A1 * | 2/2007 | Fournier | 52/726.4 |

* cited by examiner

PROTECTIVE ENCLOSURE APPARATUS TEMPORARILY ATTACHABLE TO A UTILITY POLE BASE

BACKGROUND OF THE INVENTION

1. Field of the Invention

The present invention deals with the field of devices for providing a means for temporarily protecting an exposed utility pole base and the apparatus such as wires, cables and support structure which can extend therefrom whenever a pole is not yet placed in position on the base. This circumstance can occur when a pole has been broken and removed such as by a storm or by vehicular accident. However, the apparatus of the present invention can also be utilized in new construction areas where pole bases are installed but the poles are either not available yet or for one reason or another such as by construction backlog and the like.

The apparatus of the present invention is particularly usable for protecting the utility pole base and utility apparatus extending therefrom to prevent damage thereto while at the same time preventing harm that can be caused to children and other wherein such a light pole base might be viewed as an attractive nuisance. Thus this apparatus provides a secure means for completely sealing a utility pole base such as a light pole and the wires, cables or structural elements protruding therefrom on a temporary basis until placement of the actual pole or other utility structure extending upwardly and outwardly from the base is achieved.

2. Description of the Prior Art

Various devices are utilized for covering utility apparatus for various purposes or other ground mounted systems such as shown in U.S. Pat. No. 4,533,786 patented Aug. 6, 1985 to V. L. Borgmeyer et al and assigned to Westinghouse Electric Corp. on a "Padmounted Transformer Enclosure"; and U.S. Pat. No. 5,201,599 patented Apr. 13, 1993 to J. H. Kulp et al and assigned to TrafFix Devices, Inc. on a "Stabilized Barrel-Like Traffic Control Element"; and U.S. Pat. No. 5,266,738 patented Nov. 30, 1993 to D. W. MacVoy and assigned to United Lighting Standards, Inc. on a "Universal Fixture Mount And Method Of Assembly"; and U.S. Pat. No. 5,412,960 patented May 9, 1995 to B. A. James et al and assigned to Diversified Control, Inc. on a "Lock Structure"; and U.S. Pat. No. 5,481,846 patented to C. J. Macchietto on Jan. 9, 1996 and assigned to Valmont Industries, Inc. on a "Support Pole Having A Bell-Shaped Lower End"; and U.S. Pat. No. 5,524,411 patented Jun. 11, 1996 to R. G. Crossman on a "Handhole Cover"; and U.S. Pat. No. 5,580,022 patented Dec. 3, 1996 to G. M. Bach et al and assigned to Reynolds Consumer Products Inc. on a "Display Platform"; and U.S. Pat. No. 5,664,394 patented Sep. 9, 1997 to J. S. Sweeney and assigned to DiversiTech Corporation on a "Base For Equipment"; and U.S. Pat. No. 5,739,464 patented Apr. 14, 1998 to H. S. Adkins et al and assigned to ABB Power T&D Company Inc. on a "Padmounted Transformer Enclosure And Latch"; and U.S. Pat. No. 5,749,555 patented May 12, 1998 to D. H. Albrecht and assigned to Composite Structures International, Inc. on a "Height Compensating Device"; and U.S. Pat. No. 5,878,540 patented Mar. 9, 1999 to J. N. Morstein and assigned to Site Photometrics, Inc. on a "Utility Pole Base Pan With Drain"; and U.S. Des. Pat. No. Des. 411,509 patented Jun. 29, 1999 to R. R. Schlegel and assigned to PenCell Plastics, Inc. on a "Transformer Mounting Pad"; and U.S. Pat. No. 5,975,727 patented Nov. 2, 1999 to J. N. Morstein et al and assigned to Site Photometrics, Inc. on an "Exterior Light Pole Mounting Bracket" and U.S. Pat. No. 6,186,468 patented Feb. 13, 2001 to R. R. Schlegel and assigned to PenCell Plastics, Inc. on a "Mounting Pad Apparatus For Supporting And Moving An Electrical Power Transformer While Positioned Thereon"; and U.S. Pat. No. 6,216,414 patented Apr. 17, 2001 to M. L. Feldberg and assigned to Valmont-Lexington Corp. on a "Hinge Base Construction For Light Poles"; and U.S. Pat. No. 6,464,196 patented Oct. 15, 2002 to J. P. Crookham et al and assigned to Mucso Corporation on an "Apparatus And Method For A Temporary Spread Footing"; and U.S. Pat. No. 6,518,499 patented Feb. 11, 2003 to S. S. Kessler and assigned to Utility Marketing Corporation on a "Box Pad For Mounting Electrical Equipment"; and U.S. Pat. No. 6,910,826 patented Jun. 28, 2005 to A. A. Damiano and assigned to Valmont Industries, Inc. on a "Breakaway Coupling"; and U.S. Pat. No. 6,971,320 patented Dec. 6, 2005 to D. Maldonado-Cortes et al and assigned to Prolec GE, S.de R.L. de C.V. on a "Single Versatile And Fast Mounting Pad For Transporting And Supporting Different Sizes Of Electrical Distribution Transformers"; and U.S. Pat. No. 6,997,426 patented to C. R. Barrepski on Feb. 14, 2006 on a "Grounded Holding Device And Method Of Use".

SUMMARY OF THE INVENTION

The present invention provides a protective enclosure apparatus which is temporarily attachable to a utility pole base which normally will include a utility apparatus extending therefrom such as cables, wires or support structure for the pole itself. The protective enclosure includes a base member preferably formed of a thermoplastic polymer material which defines an access opening extending therethrough which facilitates the passing of the utility apparatus therethrough for securement therewithin. This access opening preferably defines an opening center point centrally located within the opening. The base member further defines a plurality of mounting slots extending radially outwardly from the access opening to facilitate mounting thereof with respect to the utility pole base. These mounting slots preferably include four individual slots extending radially outwardly from the access opening to facilitate securement of the base member with respect to different utility pole bases of various sizes and configurations. Each of the four individual slots is preferably diagonally oriented with respect to one another and extending radially outwardly from the access opening at approximately 90 degrees with respect to one another.

The base member also preferably defines a mounting recess in the uppermost edge thereof. Each of the these four individual slots are defined within the base member at an orientation extending radially outwardly from the opening center point of the access opening and they also extend into the access opening to be in full fluid flow communication therewith. The base member further defines a mounting key preferably extending outwardly therefrom into the mounting recess in order to be engageable with respect to the housing member for facilitating keyed engaging oriented abutment between the base member and the housing member. The base member preferably includes an elevated platform member extending upwardly from the mounting recess to extend outwardly therefrom.

This apparatus is particularly usable with utility pole bases having a plurality of equally spaced upwardly extending mounting studs normally four in number. The individual mounting slots of the base are also preferably equally spaced to be complementary therewith. They are defined extending outwardly from the access opening within the base member to receive the mounting studs extending therethrough to facilitate detachable engagement therewith for detachably securing the base with respect to the utility pole base. The individual mounting slots are defined in the base member and are oriented and aligned extending radially outwardly from the opening center point of the access opening to facilitate detachable securement thereof with respect to various different configurations and sizes of utility pole bases all of which normally include equally spaced upwardly extending mounting studs of various sizes and spacing therebetween.

The protective enclosure apparatus further includes a support frame preferably formed of a metallic material which is secured to the base member and extends outwardly therefrom to facilitate the defining of a containment chamber adjacent the base member for covering thereof and for protectively containing the utility apparatus extending therefrom. This support frame is preferably U-shaped and defines a first end section and a second end section radially adjustably securable to the base member. The first end section preferably defines a first longitudinal engagement slit and the second end section preferably defines a second longitudinal engagement slit to facilitate radially adjustable securement between the support frame and the base member and particularly for varying the total distance therebetween to facilitate mounting of a housing thereto.

The present invention further includes a housing member preferably formed of a thermoplastic polymer material secured to the support frame and extending thereover to prevent external access to the utility light pole base and to the utility apparatus positioned within the containment chamber. The housing member is adapted to engage the base member responsive to securement with respect to the support frame to facilitate protective covering of the utility pole base and the utility apparatus and to prevent access to the containment chamber therewithin. The housing member preferably is adapted to extend into the mounting recess to facilitate engagement of the housing member to the base member responsive to securement of the housing member to the support frame.

The housing member further includes preferably a continuously solid protective covering member extending around the support framework and in full continuous engagement with respect to the base member for preventing access to the utility pole base and utility apparatus therein. The housing member preferably defines a mounting groove extending longitudinally therewithin which is engageable with respect to at least a portion of the support frame to facilitate orientation of attachment between the housing member and the support frame. This mounting groove which is defined in the housing member is adapted to receive the mounting key extending thereinto for facilitating keyed engaging oriented abutment between the base member and the housing member. The elevated platform area of the base member will be defined extending outwardly from the mounting recess to extend at least partially outwardly therefrom into the containment chamber responsive to engagement of the housing member with respect to the mounting recess of the base member responsive to attaching of the housing member to the support frame for the purpose of facilitating restricting of access to the containment chamber therewithin. The base member defines the access opening and the mounting slot in the elevated platform area itself.

Furthermore the present invention includes a primary securement mechanism for detachably securing the housing member with respect to the support frame with the housing member positioned in engagement with respect to the base member to restrict access with respect to the containment chamber and to utility pole base and the utility apparatus itself.

It is an object of the present invention to provide a protective enclosure apparatus which is temporarily attachable to a utility pole base which includes utility apparatus such as support structure, wires and cables extending therefrom which is very easy to install.

It is an object of the present invention to provide a protective enclosure apparatus which is temporarily attachable to a utility pole base which includes utility apparatus such as support structure, wires and cables extending therefrom which is reusable.

It is an object of the present invention to provide a protective enclosure apparatus which is temporarily attachable to a utility pole base which includes utility apparatus such as support structure, wires and cables extending therefrom which can be made of any color and is particularly noticeable and useful when made in universal orange.

It is an object of the present invention to provide a protective enclosure apparatus which is temporarily attachable to a utility pole base which includes utility apparatus such as support structure, wires and cables extending therefrom which includes an outer housing made of high impact polyethylene.

It is an object of the present invention to provide a protective enclosure apparatus which is temporarily attachable to a utility pole base which includes utility apparatus such as support structure, wires and cables extending therefrom which provides a solution for protecting light pole bases after damaging of poles extending therefrom.

It is an object of the present invention to provide a protective enclosure apparatus which is temporarily attachable to a utility pole base which includes utility apparatus such as support structure, wires and cables extending therefrom which is an ideal solution for covering utility pole bases prior to the initial installation of utility poles in a new construction area.

It is an object of the present invention to provide a protective enclosure apparatus which is temporarily attachable to a utility pole base which includes utility apparatus such as support structure, wires and cables extending therefrom which can be installed with conventional hand equipment in a very short period of time.

It is an object of the present invention to provide a protective enclosure apparatus which is temporarily attachable to a utility pole base which includes utility apparatus such as support structure, wires and cables extending therefrom which is usable with various different sizes of utility pole base configurations.

It is an object of the present invention to provide a protective enclosure apparatus which is temporarily attachable to a utility pole base which includes utility apparatus such as support structure, wires and cables extending therefrom which is usable with conventional utility pole bases which include four upwardly extending rectangularly oriented mounting studs.

It is an object of the present invention to provide a protective enclosure apparatus which is temporarily attachable to a utility pole base which includes utility apparatus such as support structure, wires and cables extending therefrom which has minimal maintenance requirements.

It is an object of the present invention to provide a protective enclosure apparatus which is temporarily attachable to a utility pole base which includes utility apparatus such as support structure, wires and cables extending therefrom which is useful in protecting inquisitive individuals such as children from possible harm resulting from contact with wires and cables which are normally otherwise protected by a utility pole itself.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
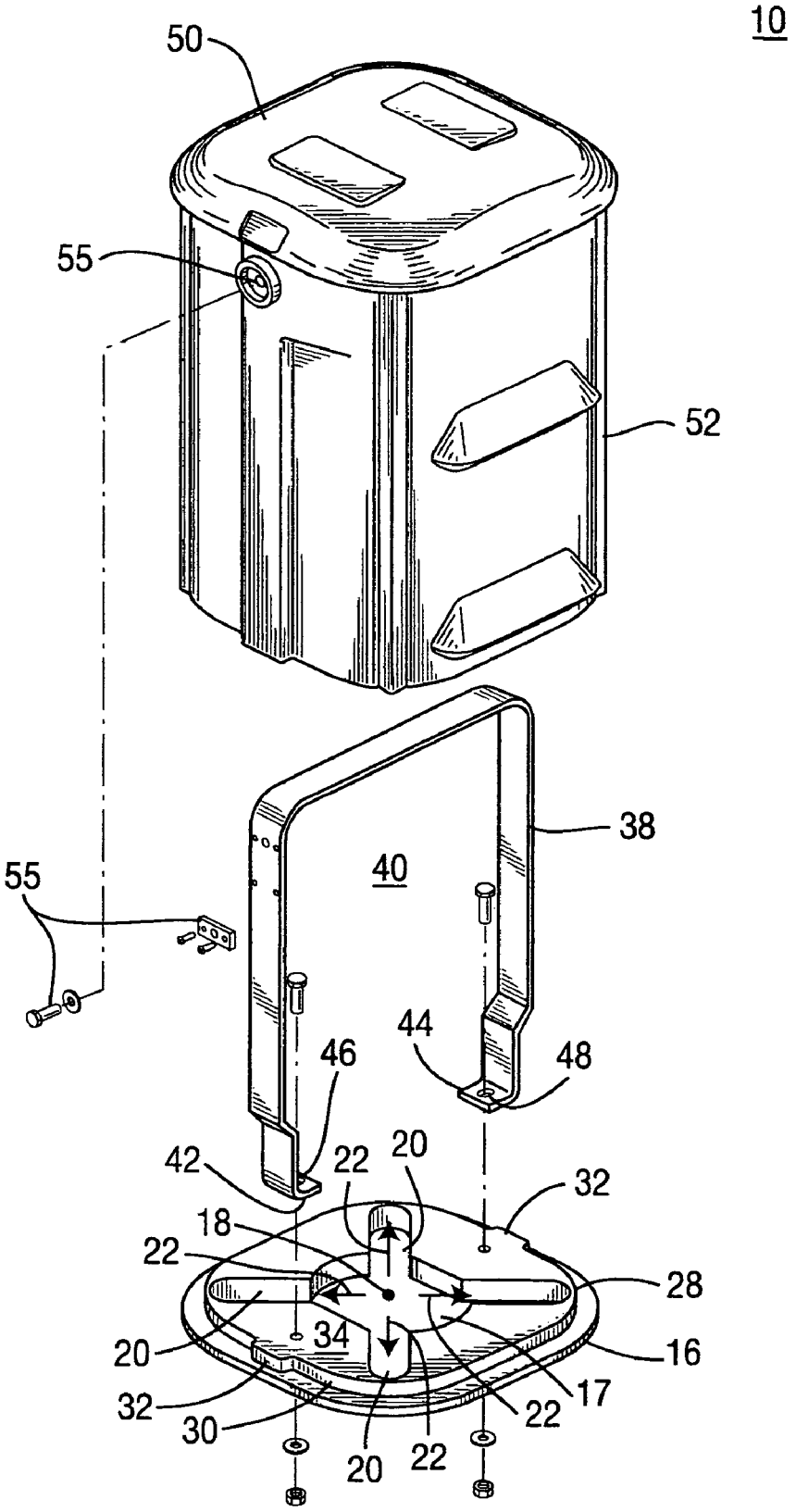
FIG. 1 is an exploded perspective illustration of a protective enclosure apparatus of the present invention.
Figure 2:
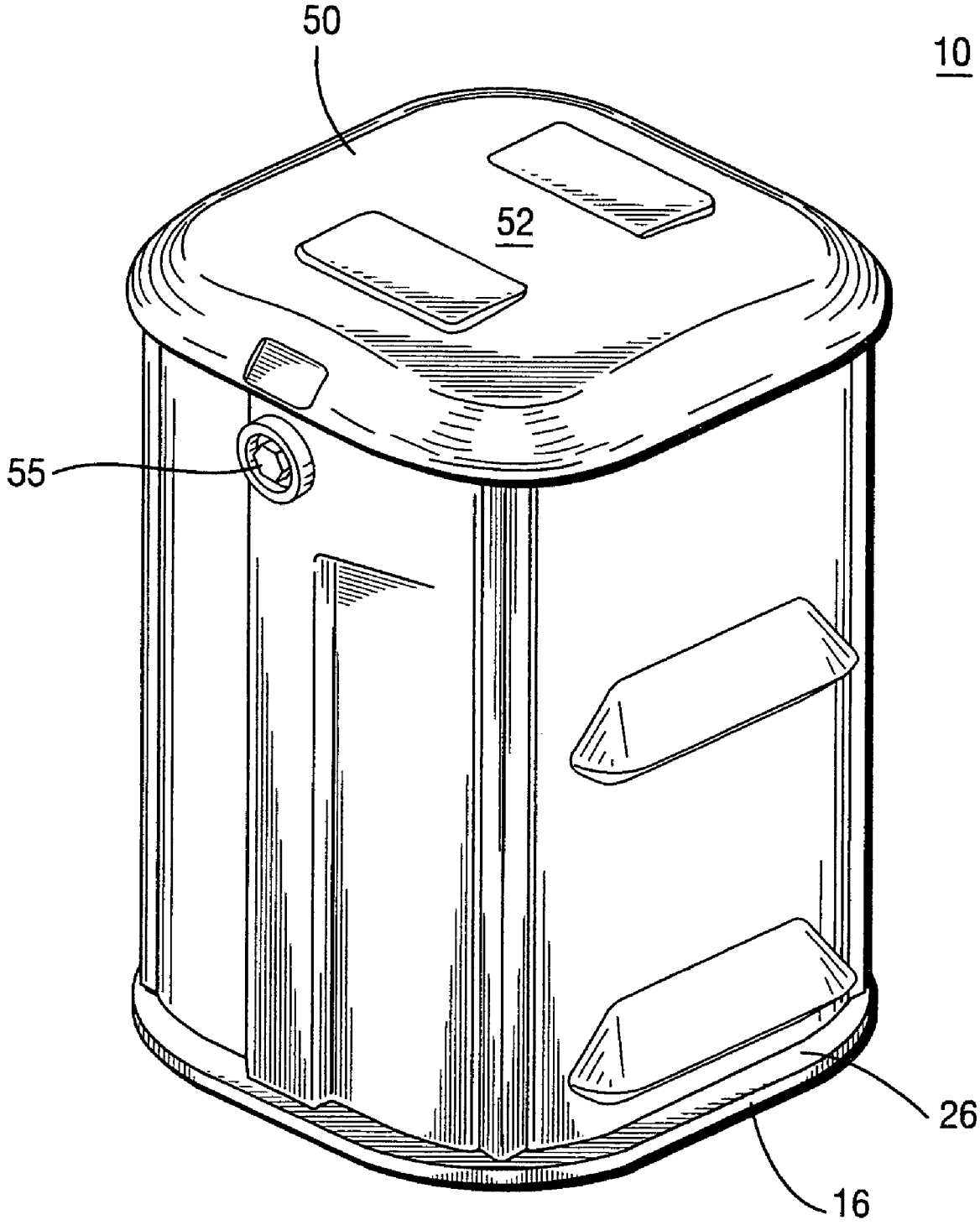
FIG. 2 is a perspective illustration of the protective enclosure apparatus of the present invention.
Figure 3:
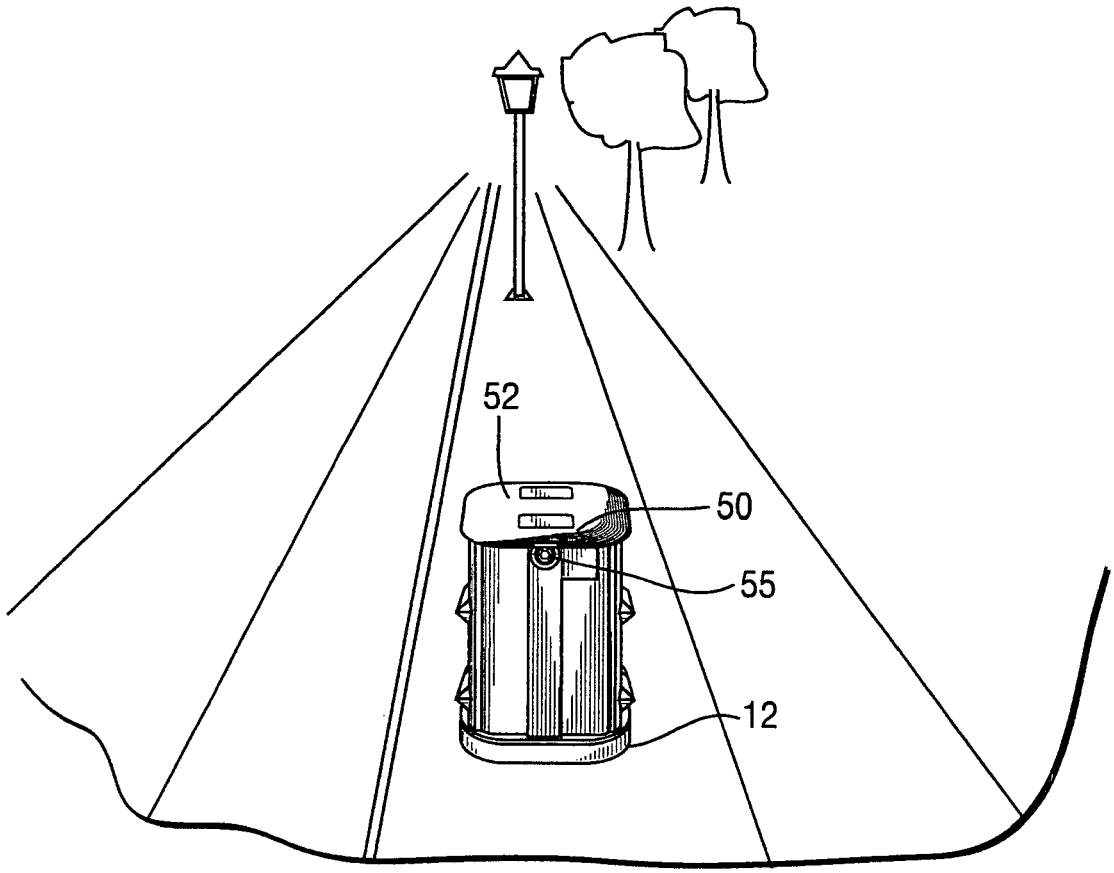
FIG. 3 is a perspective illustration of an embodiment of the protective enclosure apparatus of the present invention shown in position at a roadside.
Figure 4:
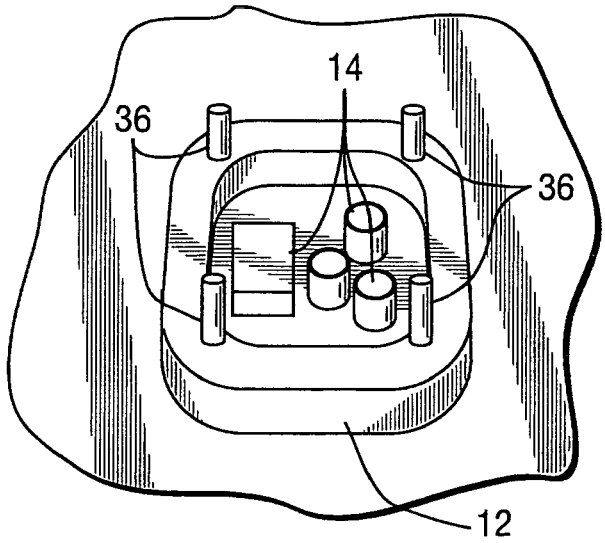
FIG. 4 is an illustration of a conventional utility pole base with wiring, cabling and/or structural members extending outwardly therefrom as used with the apparatus of the present invention.
Figure 5:
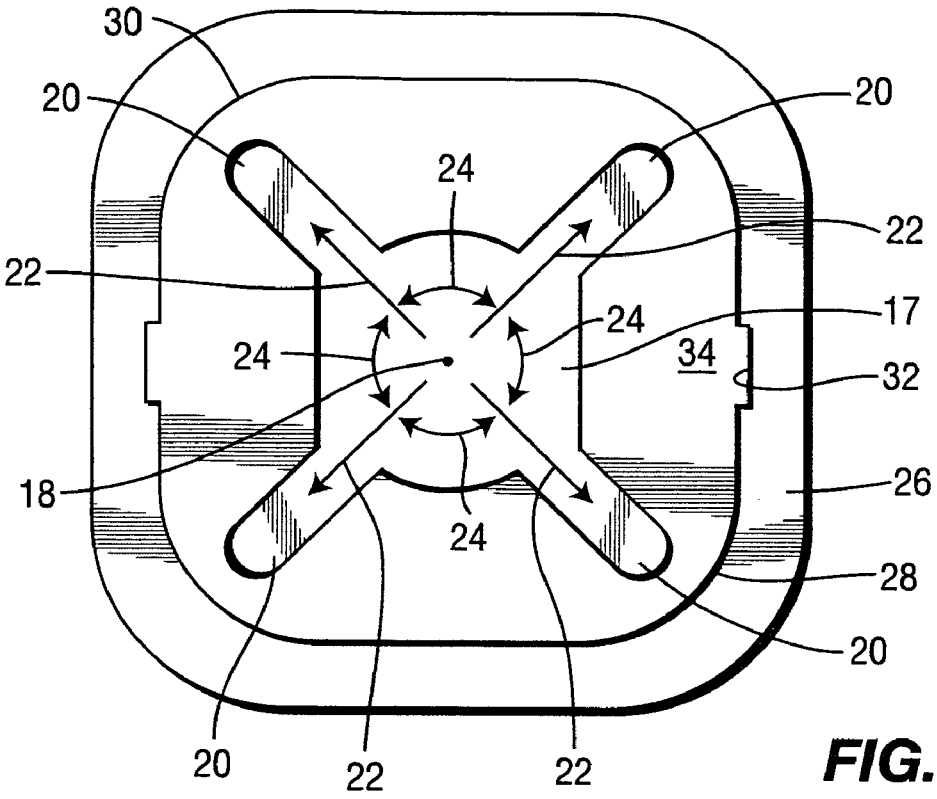
FIG. 5 is a top plan view of an embodiment of a base member used in accordance with apparatus of the present invention.
Figure 6:
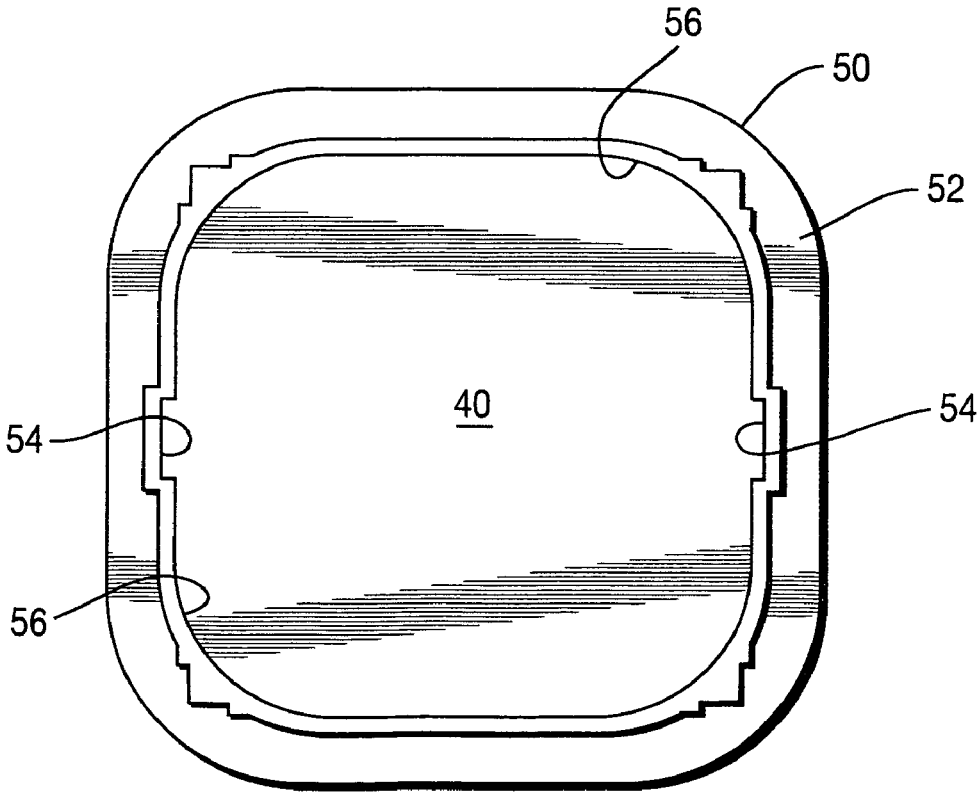
FIG. 6 is a bottom plan view of an embodiment of the housing member of the apparatus of the present invention showing the lowermost edge portion and mounting grooves defined therewithin.

The present invention discloses a protective enclosure apparatus which is designed to be temporarily attached to a utility pole base for protection of the interior components thereof whenever a utility pole is missing from the utility pole base for one reason or another. In particular the protective enclosure apparatus 10 is designed to be temporarily attached to the utility pole base 12 for protection of the utility apparatus 14 such as cables, wiring or mounting structure which may extend therefrom. Such a utility pole base 12 includes structural components to facilitate mounting of the pole thereon and also includes cables and wiring for providing electrical communication and other conduit communication to the pole for various reasons such as electrical power or other controlling mechanisms or information.

Whenever a utility pole is broken from a utility pole base 12 such as during a vehicular accident or during a major storm or other weather occurrence it is important that the upper facing of the utility pole base 12 and the utility apparatus 14 positioned therein be protected until a pole can be again placed on the base 12. The present invention provides a protective enclosure apparatus 10 which can temporarily secure it to such a utility pole base for protecting the internal components therein. At the same time the protective enclosure apparatus 10 of the present invention prevents harm to individuals from coming in contact with, such as by touching, the utility apparatus 14 within the utility pole base 12.

The apparatus of the present invention includes a base member 16 which is normally flat and is designed to be placed in a horizontal orientation upon the utility pole base 12 for securement thereto. The base member 16 preferably includes an access opening 17 defined therewithin which defines an opening center point 18 approximately centrally located therewithin.

Securement of the base member 16 with respect to a conventional four post utility pole base 12 can be achieved by defining of a plurality of mounting slots 20 within the base member 16. These mounting slots 20 preferably extend in a radial direction 22 outwardly from the access opening 17 and are preferably oriented with respect to the opening center point 18. Preferably four such mounting slots 20 are included and they are preferably separated at approximately 90 degree angles designated by reference numeral 24 with respect to one another.

These mounting slots 22 have a fairly substantial length and are in fluid flow communication with respect to the access opening 17 in such a manner that the base member 16 is usable with various different sizes of utility pole bases 12 wherein the center line distance between the mounting studs extending upwardly therefrom can vary in distance. That is, the spacing between the individual mounting studs do vary based upon the size of the pole and the amount of strength needed in the utility pole base 12 and for this reason the present invention is usable with various different configurations, sizes and shapes of such utility pole bases 12.

The present invention further includes a support frame 38 which is preferably secured to the base member 16 in such a manner as to extend outwardly therefrom and to provide a framework upon which a housing member 50 may be secured. Housing member 50 preferably includes a continuous solid protective cover member 52 which is designed to provide restriction to access to the containment chamber 40 defined within the housing 50 and in this manner minimize access to the utility pole base 12 or the utility apparatus 14 contained therein or extending therefrom. The support frame preferably includes a first end section 42 and a second end section 44 both of which are securable to the base member 16 at positioned spaced from one another normally along opposite sides of the access opening 17 defined therein. The first end section 42 preferably includes a first longitudinal engagement slit 46 and second end section 44 defines a second longitudinal engagement slit 48. It provides some lateral adjustment in the overall dimension defined between the first end section 42 and the second end section 44 of the support frame 38 to provide some versatility in orientation and configuration thereof.

The support frame defines a framework about which the housing member 50 can be positioned to define the containment chamber 40 therewithin. This containment chamber 40 is defined to hold the industrial apparatus such as wires, cables or other mounting structure which extend outwardly from the utility pole base 12 for protection thereof and restricting of access thereto.

When housing member 50 is secured to the support frame 38 it is important that the base member 16 be in engagement with the housing member 50 to facilitate sealing engagement therewith and to provide a continuously solid protective perimeter to prevent external access to the containment chamber 40 defined therewithin. This engagement is enhanced by configuring of the base member 16 in such a manner that it defines a mounting recess 26 extending therealong. This mounting recess is defined to be engageable with respect to the lowermost edge portion 56 of the housing member 50. With the lowermost edge portion 56 of housing member 50 extending into the mounting recess 26 of the base member 16 sealing engagement between the housing member 50 and the base member 16 is achieved about the entire perimeter of the base which in this manner prevents access to any area within the housing 50.

To further enhance the restricting of access the mounting recess 26 may be defined along the uppermost outer edge 28 of the base member 12 such as to form a peripheral shoulder 30 extending therearound. This peripheral shoulder 30 defines the mounting recess 28 about the outermost peripheral edge of the base member 16 and in this manner enhances restricting of access to the containment chamber 40. The base member 16 can also define an elevated platform 34 therewithin extending upwardly within the peripheral shoulder 30 and within the mounting recess 26 which extends into the containment chamber 40 for a limited distance to further enhance the sealing engagement between the housing member 50 and the base member 16 when the housing member 50 is secured to the support frame 38. Proper alignment between the housing member 50 and the support frame 38 is achieved by the inclusion of a base member 16 which defines a mounting key member 32 extending outwardly therefrom into the mounting recess 26. This mounting key 32 is defined to extend into a mounting groove 54 defined in the housing member 50 to provide a means for properly aligning the orientation of the housing member 50 relative to the base member 16 and support member 38 as desired.

Once the housing means 50 is placed into engagement with the support frame 30 with the lowermost edge portion 56 thereof extending into the mounting recess 26, a primary securement means 55 will be secured such as a bolt or pin would extend through the housing member 50 into a threaded aperture defined in the support frame 38 in order to firmly retain the housing member 50 relative to the support frame 38.

It should be appreciated that the protective enclosure apparatus 10 of the present invention defines a base member 16 preferably with four mounting slots 20 extending radially outwardly therefrom at 90 degree angles with respect to one another. This configuration is particularly usable for attachment with respect to utility pole bases 12 which include equally spaced upwardly extending studs 36 which are normally used for securement to the utility pole itself but which can be used for securement with respect to the base member 16 of the protective enclosure apparatus 10 of the present invention. One of the important aspects of the present invention is the universal capability of attachment of the base member 16 with respect to various different sizes of four posted utility base configurations 36.

In the preferred configuration the base member 16 and housing member 50 of the present invention are formed of a thermoplastic polymer material whereas the support frame 38 is formed of a metallic material such as aluminum or the like. In this manner the support frame 38 will provide structural strength whereas the base member 16 and the housing member 50 will provide electrical insulation due to the nature of the material.

With the unique configuration shown in the apparatus of the present invention the inclusion of the elevated platform area 38 provides a configuration similar to a plug as it extends into the bottom opening of the containment chamber 40 defined within the housing member 50. This plug will extend upwardly slightly perhaps only a limited distance of one inch or less but this provides a firm engagement between the lowermost edge portion 56 of the housing member 50 and the base member 16 when the base member 16 is secured to the support frame 38. In this manner movement of moisture or other contaminants into the containment chamber 40 is prevented and access to the utility apparatus 14 therewithin such as cables, wires or mounting apparatus is greatly restricted.

An important characteristic of the present invention is the coextensive positioning of the mounting slots 20 with respect to the access opening 17. These voids are in full communication with one another which greatly facilitates the alignment of the base member 16 relative to the equally spaced upwardly extending studs 36 of a utility pole base 12. Such studs are commonly slightly bent or are of a slightly different size, shape or spacing in the various different applications for such utility pole devices. The present invention provides a base member 16 of a universal nature which can easily be caused to engage a great variety of different sizes, shapes and configurations of base members 16 regardless of the configurations of the upwardly extending studs 36.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. A protective enclosure apparatus being temporarily attachable to a utility pole base having utility apparatus extending therefrom comprising:

A. a base member defining an access opening means extending therethrough to facilitate passing of utility apparatus therethrough, said access opening means defining an opening center point located generally centrally therewithin to allow utility apparatus to extend upwardly therethrough, said base member further defining a plurality of mounting slot means extending radially outwardly from said access opening means to facilitate mounting thereof with respect to said utility pole base, each of said individual slot means extending into said opening center point of said access opening means to be in full fluid flow communication therewith by being joined together to facilitate adjustable mounting thereof with respect to a utility pole base simultaneously with utility apparatus extending upwardly through said opening center point;

B. a support frame secured to said base member and extending outwardly therefrom to facilitate defining of a containment chamber means adjacent said base member for covering thereof and for protectively containing utility apparatus extending therefrom, said support frame being generally U-shaped and including:

(1) a first end section adjustably securable directly to said base member to facilitate mounting of said support frame directly with respect to said base member, securement of said first end section with respect to said base member being laterally adjustable in a generally horizontal direction which extends approximately parallel with respect to said base member to facilitate adjusting of the overall horizontal dimension of said support frame; and (2) a second end section adjustably securable directly to said base member at a position spatially disposed from said first end section to further facilitate mounting of said support frame directly with respect to said base member, securement of said second end section with respect to said base member being laterally adjustable in a generally horizontal direction which extends approximately parallel with respect to said base member to further facilitate adjusting of the overall horizontal dimension of said support frame; and C. a housing member secured to said support frame and extending thereover to prevent external access to the utility pole base and to the utility apparatus positioned extending into said containment chamber means, said housing member adapted to engage said base member responsive to securement with respect to said support frame to facilitate protective enclosing of the utility pole base and the utility apparatus and prevent access to said containment chamber means therewithin, adjustment of the fitting engagement of said housing member extending around said support frame being adjustable by adjusting of the position of securement of said first end section and said second end section with respect to said base member in order to facilitate engagement between said housing member and said base member and prevent access into said containment chamber means.

2. A protective enclosure apparatus being temporarily attachable to a utility pole base having utility apparatus extending therefrom as defined in claim 1 wherein said mounting slots means comprises four individual slots extending radially outwardly from said access opening means to facilitate securement of said base member with respect to utility pole bases of various sizes and configurations.

3. A protective enclosure apparatus being temporarily attachable to a utility pole base having utility apparatus extending therefrom as defined in claim 2 wherein each of said four individual slots are diagonally oriented with respect to one another extending outwardly from said access opening means at approximately ninety degrees apart.

4. A protective enclosure apparatus being temporarily attachable to a utility pole base having utility apparatus extending therefrom as defined in claim 1 wherein said base member defines a mounting recess means adapted to receive said housing member extending thereinto to facilitate engagement of said housing member to said base member responsive to securement of said housing member to said support frame.

5. A protective enclosure apparatus being temporarily attachable to a utility pole base having utility apparatus extending therefrom as defined in claim 4 wherein said mounting recess means is defined in the uppermost outer edge of said base member to facilitate abutment of said housing member therewith and further restrict access to said containment chamber means and the utility pole base.

6. A protective enclosure apparatus being temporarily attachable to a utility pole base having utility apparatus extending therefrom as defined in claim 5 wherein said base member defines a peripheral shoulder around the uppermost outer edge thereof which provides said mounting recess means to further facilitate abutting engagement of said housing member with respect to said base member responsive to attaching of said housing member to said support frame.

7. A protective enclosure apparatus being temporarily attachable to a utility pole base having utility apparatus extending therefrom as defined in claim 1 wherein said housing member defines a mounting groove extending longitudinally therewithin which is engageable with respect to at least a portion of said support frame to facilitate orientation of attachment between said housing member and said support frame.

8. A protective enclosure apparatus being temporarily attachable to a utility pole base having utility apparatus extending therefrom as defined in claim 7 wherein said base member further defines a mounting recess means extending therearound adapted to receive said housing member extending thereinto to facilitate secure engagement of said housing member to said base member with said housing member engaging said base member along said mounting recess means defined therein, and wherein said base member further defines a mounting key extending outwardly therefrom into said mounting recess means in order to be positionable extending into said mounting groove defined in said housing member for facilitating keyed engaging oriented abutment between said base member and said housing member.

9. A protective enclosure apparatus being temporarily attachable to a utility pole base having utility apparatus extending therefrom as defined in claim 1 wherein said first end section defines a first longitudinal engagement slit means extending horizontally in a direction approximately parallel to said base member to facilitate adjustable positioning of said first end section with respect to said base member in a direction extending generally parallel to said base member, said second end section defining a second longitudinal engagement slit means extending horizontally in a direction approximately parallel to said base member to facilitate adjustable positioning of said second end section with respect to said base member in a direction extending generally parallel to said base member to facilitate anproximately horizontally adjustable securement between said support frame and said base member in a direction extending approximately parallel with respect to said base member.

10. A protective enclosure apparatus being temporarily attachable to a utility pole base having utility apparatus extending therefrom as defined in claim 1 further including a primary securement means for detachably securing said housing member with respect to said support frame with said housing member positioned in engagement with respect to said base member to restrict access with respect to said containment chamber means and to the utility pole base and the utility apparatus.

11. A protective enclosure apparatus being temporarily attachable to a utility pole base having utility apparatus extending therefrom as defined in claim 5 wherein said housing member includes a lowermost edge portion extending downwardly into said mounting recess means defined in the uppermost outer edge of said base member to facilitate restricting of access to the utility pole base and the utility apparatus.

12. A protective enclosure apparatus being temporarily attachable to a utility pole base having utility apparatus extending therefrom as defined in claim 1 wherein said base member defines a mounting recess means adapted to receive said housing member extending thereinto to further facilitate secure engagement of said housing member with respect to said base member responsive to attaching of said housing member to said support frame, said base member including an elevated platform area extending outwardly from said mounting recess means to extend at least partially outwardly therefrom into said containment chamber means responsive to engagement of said housing member with respect to said mounting recess means of said base member responsive to attaching of said housing member to said support frame to facilitate restriction of access to said containment chamber means therewithin, said access opening means and said mounting slot means being defined in said elevated platform area of said base member.

13. A protective enclosure apparatus being temporarily attachable to a utility pole base having utility apparatus extending therefrom comprising:

A. a base member defining an access opening means extending therethrough to facilitate passing of utility apparatus therethrough, said access opening means defining an opening center point located generally centrally therewithin to allow utility apparatus to extend upwardly therethrough, said base member further defining a plurality of mounting slot means extending radially outwardly from said access opening means to facilitate mounting thereof with respect to said utility pole base, each of said individual slot means extending into said opening center point of said access opening means to be in full fluid flow communication therewith by being joined together to facilitate adjustable mounting thereof with respect to a utility pole base simultaneously with utility apparatus extending upwardly through said opening center point, said base member defining an elevated platform area thereon extending upwardly and further defining a peripheral shoulder positioned therearound, said base member further defining a mounting recess means circumferentially positioned extending around said peripheral shoulder;

B. a support frame secured to said base member and extending outwardly therefrom to facilitate defining of a containment chamber means adjacent said base member for covering thereof and for protectively containing utility apparatus extending therefrom; and C. a housing member secured to said support frame and extending thereover to prevent external access to the utility pole base and to the utility apparatus positioned extending into said containment chamber means, said housing member adapted to engage said base member responsive to securement with respect to said support frame to facilitate protective enclosing of the utility pole base and the utility apparatus and prevent access to said containment chamber means therewithin, said mounting recess means of said base member adapted to receive said housing member extending thereinto to facilitate engagement of said housing member to said base member responsive to securement of said housing member over said support frame, said elevated platform area adapted to extend at least partially into said containment chamber means of said housing member responsive to positioning of said base member extending over said support frame and into engagement with said mounting recess means to facilitate engagement and sealing between said housing member and said base member.

14. A protective enclosure apparatus being temporarily attachable to a utility pole base having utility apparatus extending therefrom as defined in claim 13 wherein said mounting slots means comprises four individual slots extending radially outwardly from said access opening means to facilitate securement of said base member with respect to utility pole bases of various sizes and configurations.

15. A protective enclosure apparatus being temporarily attachable to a utility pole base having utility apparatus extending therefrom as defined in claim 14 wherein each of said four individual slots are diagonally oriented with respect to one another extending outwardly from said access opening means at approximately ninety degrees apart.

16. A protective enclosure apparatus being temporarily attachable to a utility pole base having utility apparatus extending therefrom as defined in claim 13 wherein said base member further defines a mounting key extending outwardly therefrom into said mounting recess means in order to be engageable with respect to said housing member for facilitating keyed engaging oriented abutment between said base member and said housing member.

17. A protective enclosure apparatus being temporarily attachable to a utility pole base having utility apparatus extending therefrom as defined in claim 13 wherein said support frame is generally U-shaped and defines a first end section and a second end section securable to said base member to facilitate mounting of said housing member with respect to said support frame in engagement with respect to said base member.

18. A protective enclosure apparatus being temporarily attachable to a utility pole base having utility apparatus extending therefrom as defined in claim 17 wherein said first end section is adjustably securable with respect to said base member and wherein said second end section is adjustably securable in a direction oriented parallel with respect to said base member.

19. A protective enclosure apparatus being temporarily attachable to a utility pole base having utility apparatus extending therefrom as defined in claim 18 wherein said first end section and said second end section are adjustably securable with respect to said base member in a generally horizontal direction extending parallel to said base member to facilitate fixed securement of said support frame with respect to said base member to facilitate securement of said housing member to said support frame with said housing member in engaging abutment with respect to said base member in order to minimize access to said containment chamber means and the utility pole base.

20. A protective enclosure apparatus being temporarily attachable to a utility pole base having utility apparatus extending therefrom as defined in claim 19 wherein said first end section defines a first longitudinal engagement slit means and said second end section defines a second longitudinal engagement slit means to facilitate adjustable securement in a general horizontal direction between said support frame and said base member, said first slit means and said second slit means extending in a direction oriented approximately parallel to said elevated platform area of said base member to facilitate generally horizontal adjustment between said support frame and said base member.

21. A protective enclosure apparatus being temporarily attachable to a utility pole base having utility apparatus extending therefrom as defined in claim 13 further including a primary securement means for detachably securing said housing member with respect to said support frame with said housing member positioned in engagement with respect to said base member to restrict access with respect to said containment chamber means and to the utility pole base and the utility apparatus.

22. A protective enclosure apparatus being temporarily attachable to a utility pole base having utility apparatus extending therefrom as defined in claim 13 wherein said housing member includes a lowermost edge portion extendable downwardly into engagement with respect to said mounting recess means defined in said base member to facilitate engagement between said housing member and base member to facilitate restricting access to the utility pole base and the utility apparatus.

* * * * *